US005249983A

United States Patent [19]

Hirai

[11] Patent Number: 5,249,983

[45] Date of Patent: Oct. 5, 1993

[54] ELECTRICAL CONNECTOR FOR PRINTED WIRING BOARD

[75] Inventor: Yuji Hirai, Tokyo, Japan

[73] Assignee: Honda Tsushin Kogyo Kabushiki Kaisha, Tokyo, Japan

[21] Appl. No.: 868,187

[22] Filed: Apr. 14, 1992

[30] Foreign Application Priority Data

Feb. 27, 1992 [JP] Japan ..... 4-9345[U]

[51] Int. Cl.[5] ..... H01R 13/73

[52] U.S. Cl. ..... 439/573; 439/567

[58] Field of Search ..... 439/554, 557, 562, 564, 439/567, 569, 571, 573

[56] References Cited

U.S. PATENT DOCUMENTS 4,889,502 12/1989 Althouse et al. ..... 439/554

5,125,853 6/1992 Hashiguchi ..... 439/607

5,163,851 11/1992 Hart et al. ..... 439/607

*Primary Examiner*—Gary F. Paumen

*Attorney, Agent, or Firm*—Armstrong, Westerman, Hattori, McLeland & Naughton

[57] ABSTRACT

An electrical connector main body has a pair of mounting portions provided on both sides of a fitting portion which fits into a mating connector. A nut-placing recess is provided on an upper surface of each of the mounting portions. A parallel pair of slit-like apertures are provided on both sides of each of the nut-placing recess. Each of the nut-placing recess has at the bottom thereof a bolt-inserting aperture, and at least a pair of grooves which are oppositely provided on an internal surface of the bolt-inserting aperture along its axial line. A nut is fitted into the nut-placing recess and a bolt for fastening a printed wiring board is inserted into the bolt-inserting aperture so that the bolt can be screwed into the nut.

5 Claims, 8 Drawing Sheets

ELECTRICAL CONNECTOR FOR PRINTED WIRING BOARD

BACKGROUND OF THE INVENTION

This invention relates to an electrical connector which is mounted on a printed wiring board.

A conventional electrical connector for a printed wiring board is mounted on a printed wiring board in the following manner depending on the specification of the user, i.e., by using a bolt and a nut, by using a plate-like lock member which has two pieces of branched pieces each provided with a locking projection on an outside thereof, or by using, aside from the lock member, a hold-down member for holding down the electrical connector to the printed wiring board.

When the above-mentioned conventional electrical connector for a printed wiring board is used, it is required to prepare a connector main body of different construction depending on varying mounting method. It has therefore a disadvantage in that the cost of the electrical connector becomes high.

OBJECT AND SUMMARY OF THE INVENTION

This invention has an object of providing an electrical connector which solves the above-mentioned disadvantage of the conventional electrical connector for a printed wiring board.

In order to attain the above object, according to a first aspect of this invention, there is provided an electrical connector for a printed wiring board comprising: an electrical connector main body having a pair of mounting portions provided on both sides of a fitting portion which fits into a mating electrical connector; a nut-placing dented portion provided on an upper surface of each of the mounting portions; a pair of slit-like apertures which are disposed in parallel on both sides of each of the recess; the nut-placing recess having at a bottom there of a bolt-inserting aperture; and the bolt-inserting aperture having at least a pair of grooves which are oppositely provided on an internal surface of the bolt-inserting aperture along its axial line.

According to a, second, aspect of this invention, there is provided an electrical connector for a printed wiring board according to the first aspect of this invention, further comprising: a nut which is fitted into the nut-placing recess; and a bolt for fastening the printed wiring board, the bolt being fitted into the bolt-inserting aperture and screwed into the nut.

According to a third aspect of this invention, there is provided an electrical connector for a printed wiring board according to the first aspect of this invention, further comprising: a plate-like lock member having two ends, one end thereof being fitted into one of the slit-like aperture, and the other end thereof which constitutes a board-locking portion for locking the electrical connector to the printed wiring board being extended beyond a lower surface of the connector main body through the pair of grooves.

According to a fourth aspect of this invention, there is provided an electrical connector for a printed wiring board according to the first aspect of this invention, further comprising: a nut which is fitted into the nut-placing recess; a plate-like hold-down member having, on both ends of one direction, a pair of wing pieces in parallel which are fitted from above into the pair of slit-like apertures and, on one of the remaining ends, a board-fixing portion for fixing the electrical connector to the printed wiring board, the board-fixing portion being extended outwards at a lower surface of the connector main body; and a bolt for fastening a printed wiring board, the bolt being inserted into the bolt-inserting aperture and screwed into the nut.

According to a fifth aspect of this invention, there is provided an electrical connector for a printed wiring board according to the first aspect of this invention, further comprising: a plate-like lock and hold-down member which is integrally made up of a pair of wing pieces in parallel, a board-locking portion for locking the electrical connector to the printed wiring board, and a board-fixing portion for fixing the electrical connector to the printed wiring board; the pair of wing pieces in parallel being fitted from above into the pair of slit-like apertures; the board-locking portion being extended beyond a lower surface of the connector main body through the pair of grooves; and the board-fixing portion being extended outwards at the lower surface of the connector main body.

In the case where the connector for a printed wiring board of this invention is mounted on the printed wiring board using nuts and bolts, a nut is fitted into each of the nut-placing recesses which are provided on the upper surface of the connector main body and a bolt is inserted into each of the bolt-inserting apertures through a hole in the printed wiring board and is screwed into the nut. In the case where the plate-like lock member having on one end a board-locking portion is used for mounting the electrical connector on the printed wiring board, one end of the lock member is fitted into one of the slit-like apertures so that the board-locking portion is extended beyond the lower surface of the connector main body through the pair of grooves which are oppositely provided on the internal surface of the bolt-inserting aperture. The board-locking portion is engaged with an edge of a throughgoing hole in the printed wiring board and is further soldered to an electric conducting portion of the throughgoing hole. When using the plate-like hold-down member having, on both ends of one direction, a pair of wing pieces in parallel and, on one of the remaining ends, a board-fixing portion for fixing the connector to the printed wiring board as well as a bolt and a nut for mounting the connector, a nut is fitted into each of the nut-placing dented portions; and a bolt is inserted into each of the bolt-inserting apertures through a throughgoing hole in the printed wiring board and is screwed into the nut. The pair of wing pieces, on both ends of one direction, of the plate-like hold-down member are fitted from above into the pair of slit-like apertures in the connector main body. The board-fixing portion, on one of the remaining ends, which is extended outwards at the lower surface of the connector main body is fixed to the printed wiring board on which the connector is mounted. When using the plate-like lock and hold-down member which is integrally made up of a pair of wing pieces in parallel, a board-locking portion and a board-fixing portion for mounting the connector, a pair of wing pieces of the plate-like lock and hold-down member are fitted from above into the pair of slit-like apertures in the connector main body. The board-locking portion is extended beyond the lower surface of the connector main body through the pair of slots which are oppositely provided on the internal surface of the bolt-inserting perforation. The board-locking portion is engaged with an edge of the throughgoing hole in the printed wiring board and is further soldered to an electric conducting portion of the throughgoing hole. The board-fixing portion which is extended outwards at the lower surface of the connector main body is fixed to the printed wiring board.

BRIEF DESCRIPTION OF THE DRAWINGS

The above and other objects as well as the accompanying advantages of this invention will become readily apparent by reference to the following detailed description when considered in conjunction with the accompanying drawings wherein.

DETAILED DESCRIPTION OF PREFERRED EMBODIMENTS

Preferred embodiments of this invention will now be explained with reference to the accompanying drawings.

Figure 1:
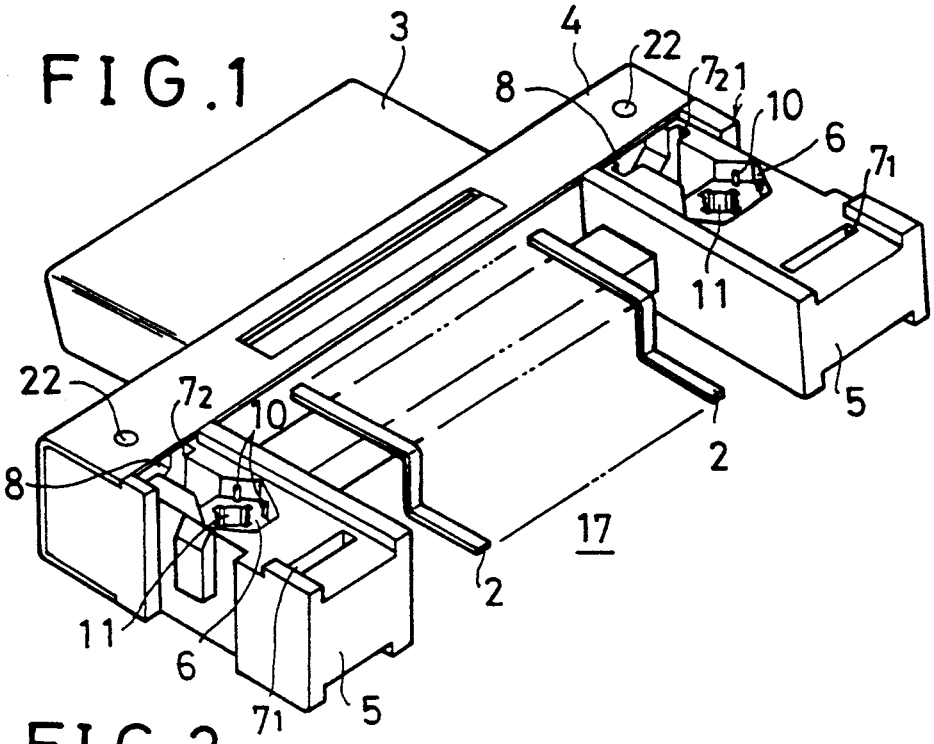
FIG. 1 is a perspective view of one example of an electrical connector for a wiring board of this invention.

FIG. 1 shows an electrical connector for a printed wiring board according to an embodiment of this invention.

In FIG. 1, numeral 1 denotes a connector main body made of a synthetic resin and numeral 2 denotes electric contacts.

The connector main body 1 is partly covered with a metallic shell 4 for electromagnetic shielding at a fitting portion 3 which fits into a mating connector and at part of the adjoining surface. Numerals 5, 5 denote mounting portions which are formed on both sides of the fitting portion 3. On an upper surface of each of the mounting portions 5, there are formed a hexagonal nut-placing recess 6, slit-like apertures $7_1$, $7_2$ which are on both sides of the nut-placing recess 6 and are in parallel with respect to each other, and a nut-fitting aperture 8 which is in communication with the slit-like aperture $7_2$ (see FIG. 2). On a bottom surface of each of the mounting portions 5, there is formed a positioning projection 9 for positioning the electrical connector relative to a printed wiring board (see, for example, FIG. 3B). On an internal surface of each of the nut-placing recess, there are formed extended projections 10 for fitting the nut into the nut-placing recess 6. On the bottom of the nut-placing recess 6, there is formed a bolt-inserting aperture 11. On the internal surface of this aperture 11, there are formed two pairs of diametrically opposing engaging grooves $12_1$, $12_1$; $12_2$, $12_2$ which extend in the axial direction of the aperture. The metallic shell 4 is fixed to the connector main body 1 after a nut 21 has been fitted into the nut-fitting perforation 8 in the connector main body 1, as shown in FIGS. 2 and 3.

Figure 2:
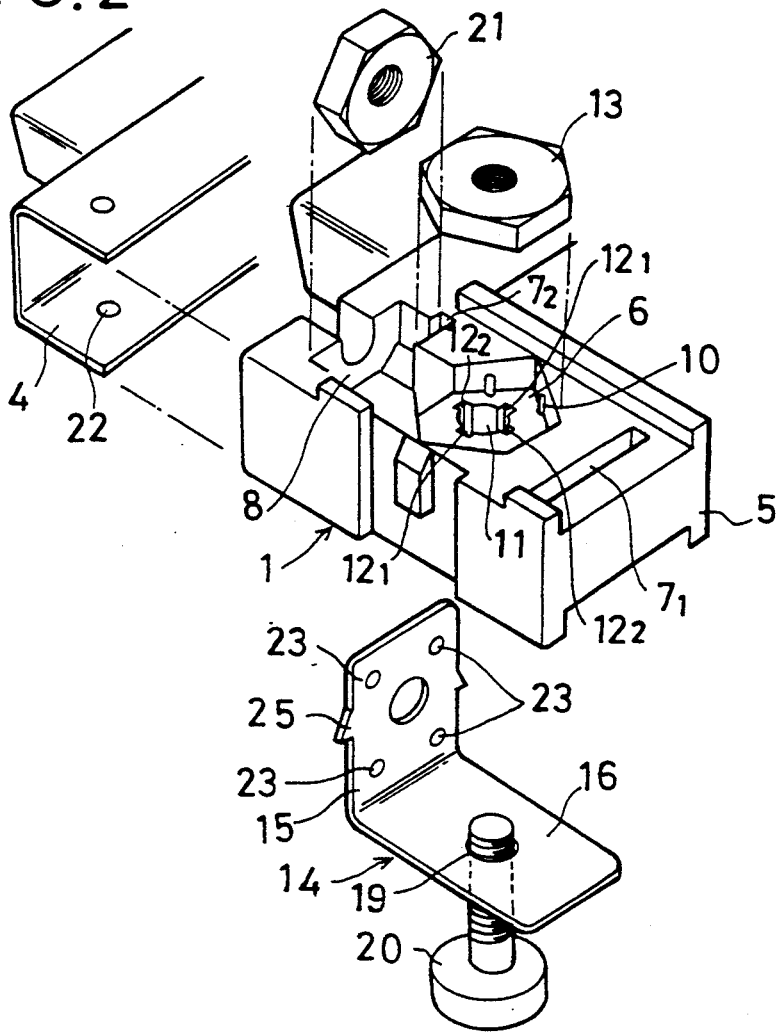
FIG. 2 is an exploded perspective view of an embodiment of the electrical connector shown in FIG. 1 further comprising a bolt, a nut, and the like for mounting it to a printed wiring board.
Figure 3A:
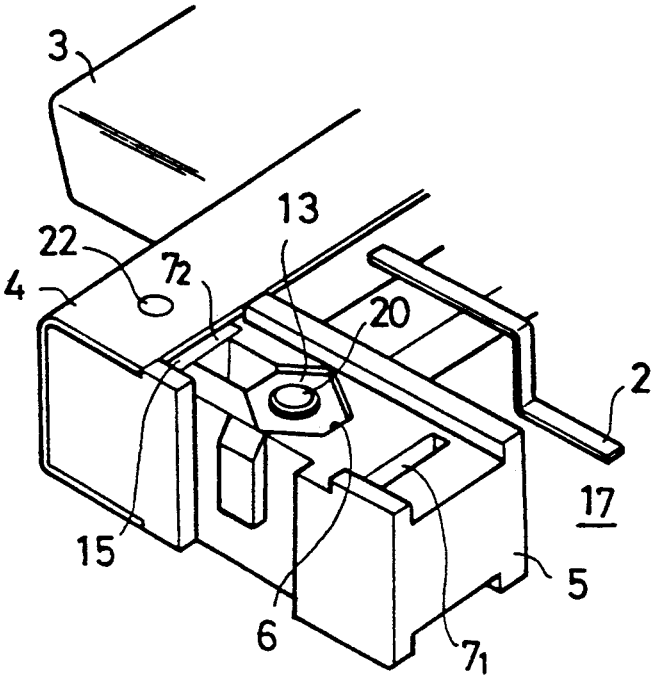
FIG. 3A is a perspective view of the embodiment shown in FIG. 2 as mounted on the printed wiring board.
Figure 3B:
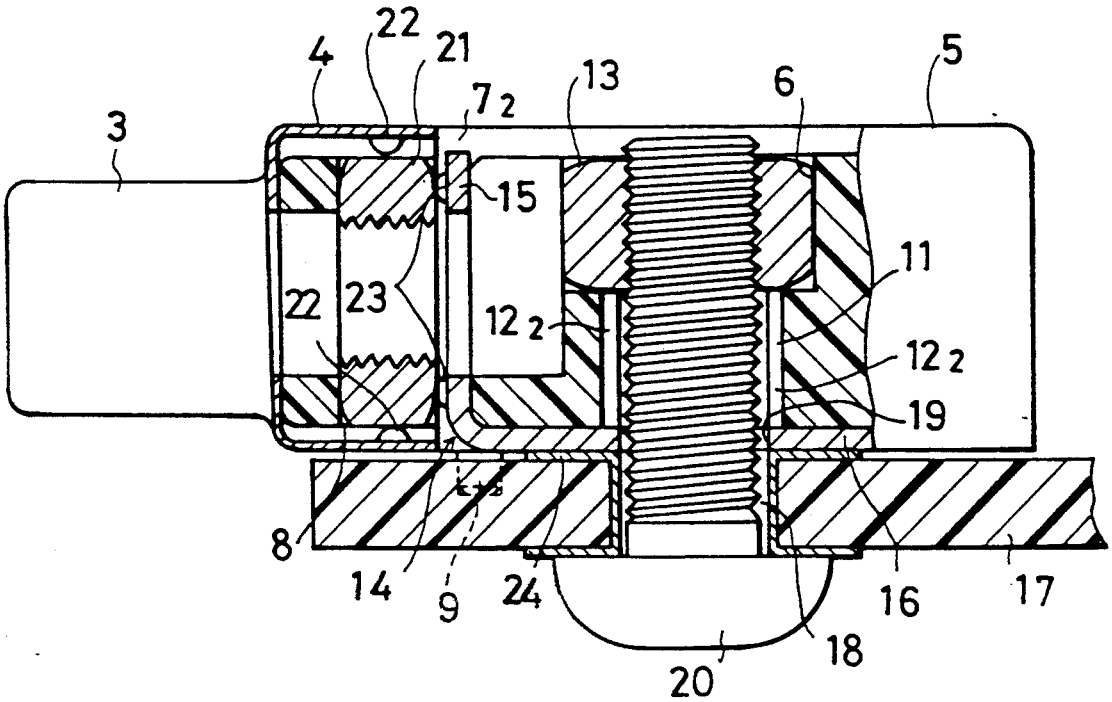
FIG. 3B is a sectional view thereof.

FIGS. 2 and 3 show an embodiment of this invention in which a nut and a bolt for mounting the electrical connector on the printed wiring board are provided on the connector shown in FIG. 1.

A nut 13 is fitted into each nut-placing recess 6 of the mounting portion 5. A vertical piece 15 of an L-shaped metallic plate 14 is inserted into the slit-like aperture $7_2$ and a horizontal piece 16 is laid along the bottom surface of the connector main body 1. This electrical connector is mounted on the printed wiring board 17 by inserting a bolt 20 through a throughgoing hole 18 in the printed wiring board 17, a hole 19 in the L-shaped metallic plate 14 and the bolt-inserting aperture 11 and screwing there of into the nut 13. The metallic shell 4 is electrically connected for grounding to an electric conducting portion 24 of the printed wiring board 17 via the projections 22 provided on the metallic shell 4 which pressingly contact the periphery of the nut 21, and the L-shaped metallic plate 14 which contacts a side surface of the nut 21 via projections 23.

In FIG. 2, projections 25, 25 which are formed on both sides of the vertical piece 15 of the L-shaped metallic plate 14 perform the function of seizing the walls of the rectangular aperture $7_2$ when the vertical piece 15 is inserted thereinto, thereby fixing the L-shaped metallic plate 14.

Figure 4:
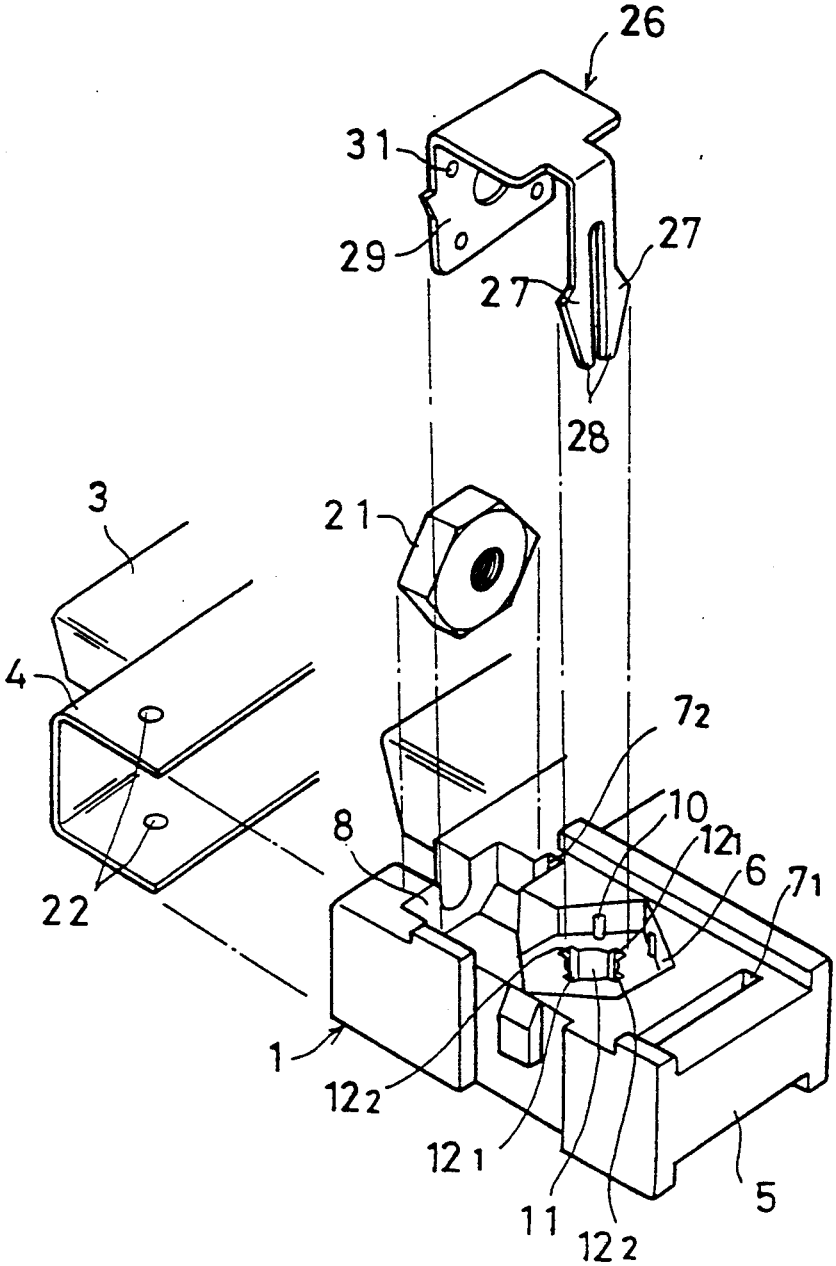
FIG. 4 is an exploded perspective view of an important portion of another embodiment comprising the electrical connector shown in FIG. 1 and a plate-like lock member for mounting the electrical connector on the printed wiring board.
Figure 5A:
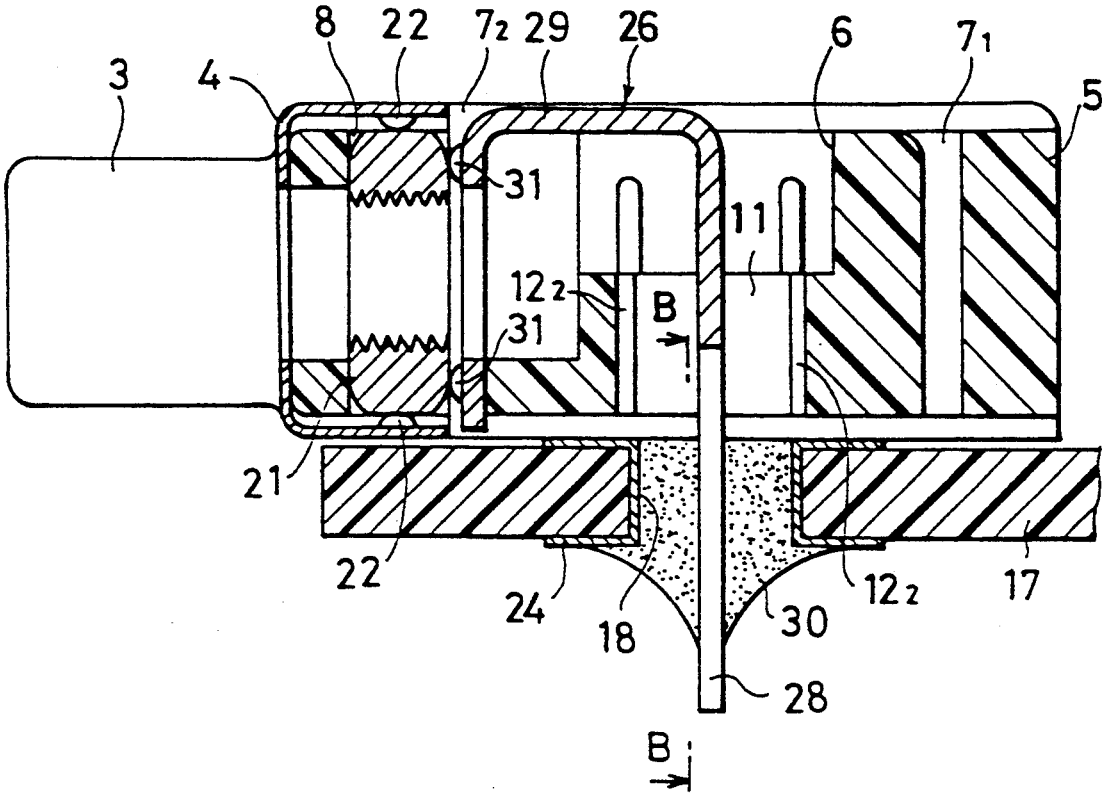
FIG. 5A a sectional view of an important portion of the embodiment of the connector of this invention shown in FIG. 4 as mounted on the printed wiring board.
Figure 5B:
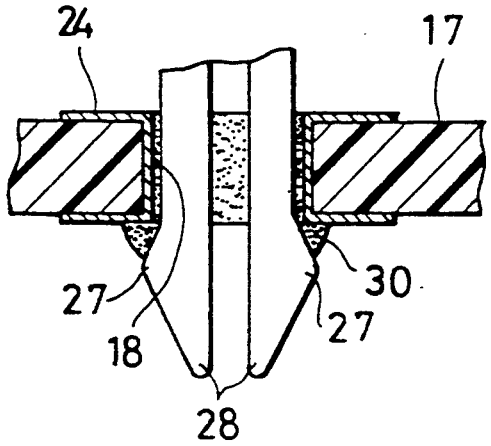
FIG. 5B is a sectional view viewed from the line B—B in FIG. 5A.

FIGS. 4 and 5 show another embodiment of the electrical connector of this invention shown in FIG. 1, further including a plate-like lock member.

The plate-like lock member 26 is bent into a U-shape configuration. The plate-like lock member 26 has an one end thereof a board-locking portion (i.e., a portion for locking the connector to the printed wiring board) includes two pieces of branched pieces 28, 28 which are provided on their outer sides thereof with locking projections 27, 27, and has on the other end a connector main body fixing portion 29 (i.e., a portion for fixing the connector main body to the printed wiring board). This plate-like lock member 26 is fixed by pressingly inserting the connector main body fixing portion 29 into the slit-like aperture $7_2$ of the connector main body 1. The branched pieces 28, 28 are projected beyond the lower surface of the connector main body 1 through the pair of grooves $12_1$, $12_1$ in the bolt-inserting aperture 11.

The electrical connector is placed on the printed wiring board 17 and the branched pieces 28, 28 are inserted, by narrowing their distance, into the throughgoing hole 18 in the printed wiring board 17. The electrical connector is locked to the printed wiring board 17 by means of the locking projections 27, 27. This locking of the electrical connector is only temporary and, therefore, the electrical connector further fixed pouring a solder 30 into the throughgoing hole 18.

In this embodiment, the metallic shell 4 is electrically connected for grounding to an electric conducting portion 24 of the printed wiring board 17 via the projections 22 formed on the metallic shell 4 which pressingly contact the periphery of the nut 21, and the plate-like lock member 26 which contacts a side surface of the nut 21 via projections 31.

Figure 6:
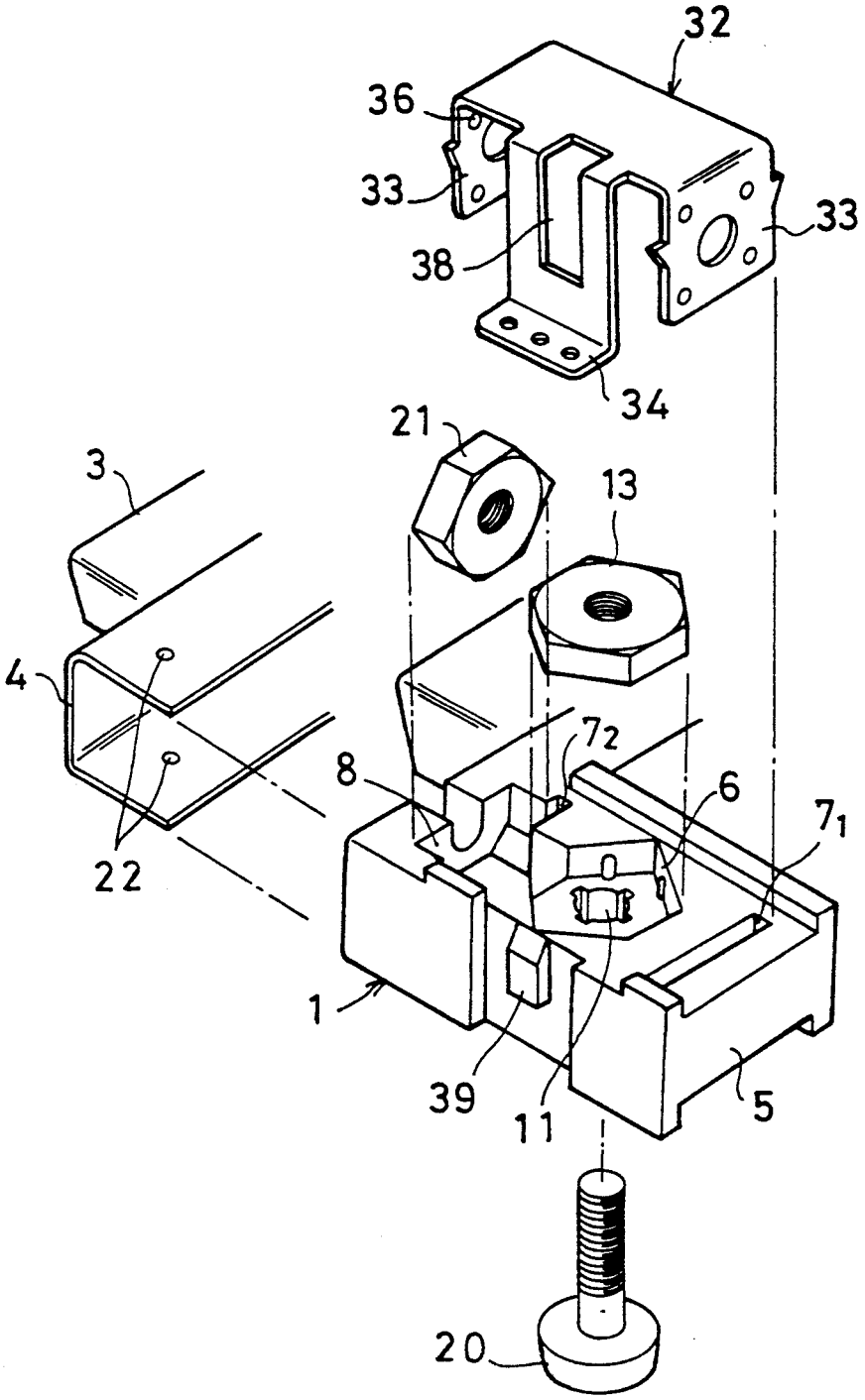
FIG. 6 is an exploded perspective view of an important portion of another embodiment of the electrical connector of this invention comprising the electrical connector shown in FIG. 1, a plate-like hold-down member for mounting the electrical connector on the printed wiring board, a bolt and a nut.
Figure 7A:
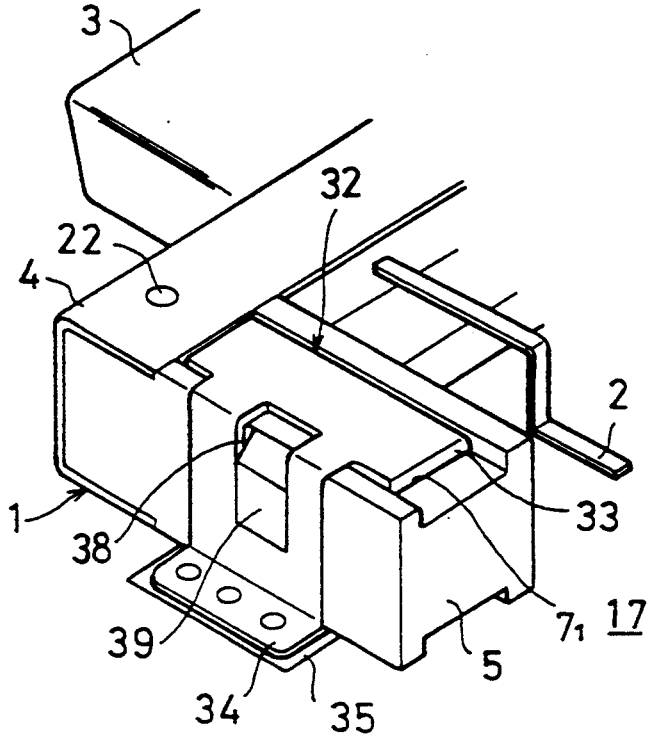
FIG. 7A is a perspective view of an important portion of the embodiment of the electrical connector shown in FIG. 6 as mounted on the printed wiring board.
Figure 7B:
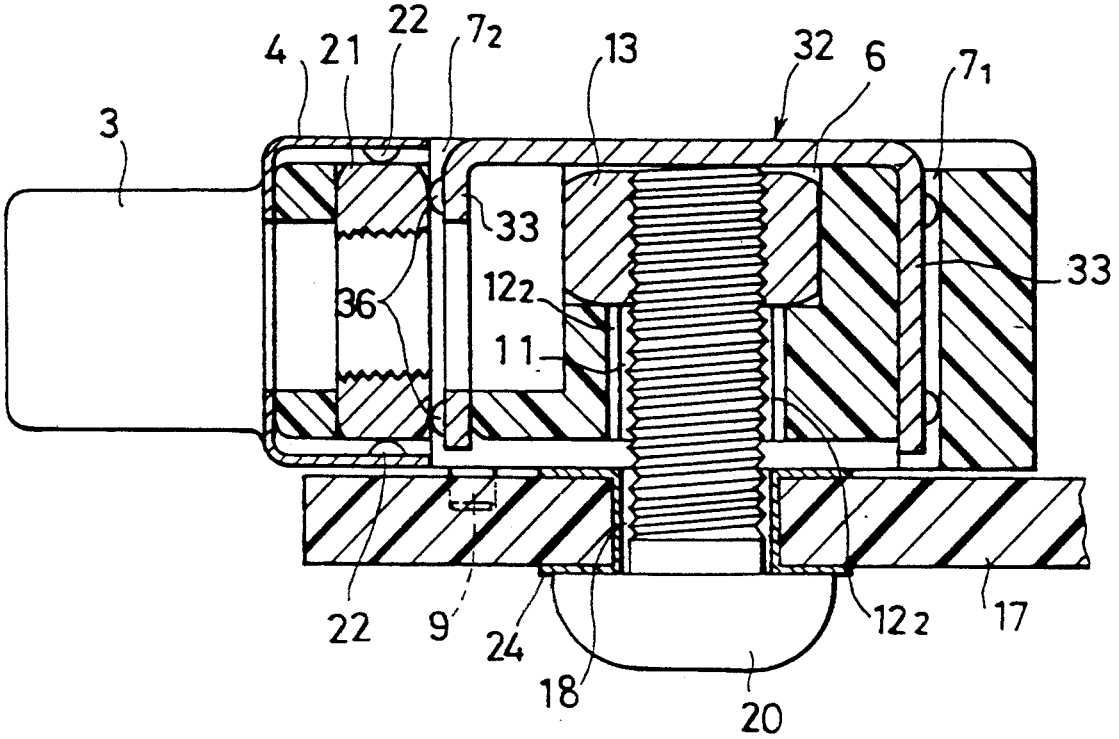
FIG. 7B is a sectional view thereof.

FIGS. 6 and 7 show a still another embodiment of the connector of this invention shown in FIG. 1, which further includes a plate-like hold-down member for mounting the connector on the printed wiring board, a nut, and a bolt.

The plate-like hold-down member 32 has, on both ends of one direction, a pair of wing pieces 33 in parallel and, on one of the remaining ends of another direction which is at right angles to the above-mentioned direction, a board-fixing portion 34 (i.e., a portion for fixing the connector to the printed wiring board).

After a nut 13 has been fitted into the nut-placing dented portion 6 in the mounting portion 5 of the connector main body 1, the pair of wing pieces 33 of the hold-down member 32 are fixed by pressingly inserting thereof into the slit-like perforations $7_1$, $7_2$. At the time of this pressing insertion, the bottom edge of a window 38 in the hold-down member 32 is engaged with the lower surface of a projection 39 on the connector main body 1. By this fixing, the board-fixing portion 34 is extended out of the lower surface of the connector main body 1.

This connector is fixed to the printed wiring board 17 by inserting a bolt 20 through a throughgoing hole 18 in the printed wiring board 17 and the bolt-inserting aperture 11 and screwing thereof into a nut 13. At the same time, the board-fixing portion 34 of the hold-down member 32 is fixed by soldering to the electric conducting portion 35 of the printed wiring board 17. It is thus possible with this electrical connector to mount the connector more securely to the printed wiring board 17 than the one shown in FIGS. 2 and 3.

The metallic shell 4 is electrically connected for grounding to the electric conducting portion 35 of the printed wiring board 17 via those projections 22 formed on the metallic shell 4 which pressingly contact the periphery of the nut 21, and the hold-down member 32 which contacts a side surface of the nut 21 via projections 36.

Figure 8:
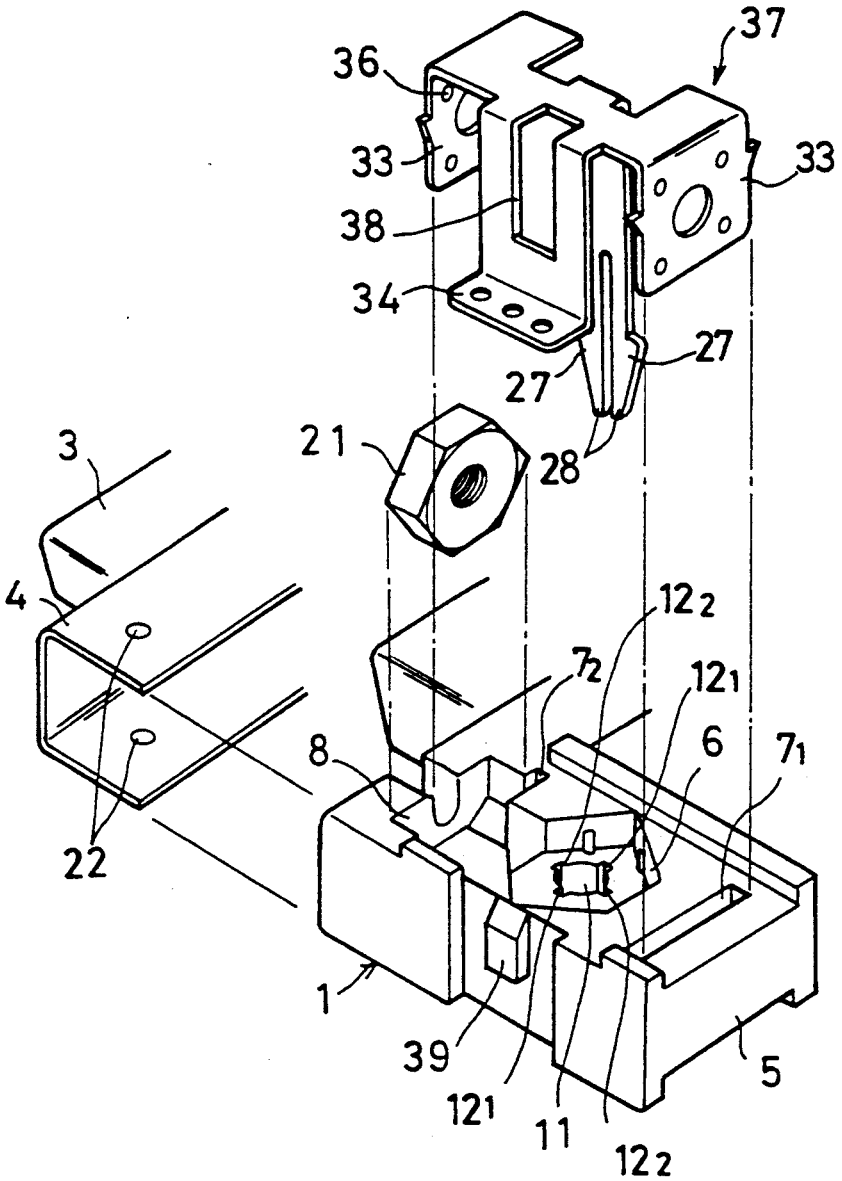
FIG. 8 is an exploded perspective view of an important portion of another embodiment of the electrical connector of this invention comprising the connector shown in FIG. 1 and a plate-like lock and hold-down member for mounting the electrical connector on the printed wiring board.
Figure 9A:
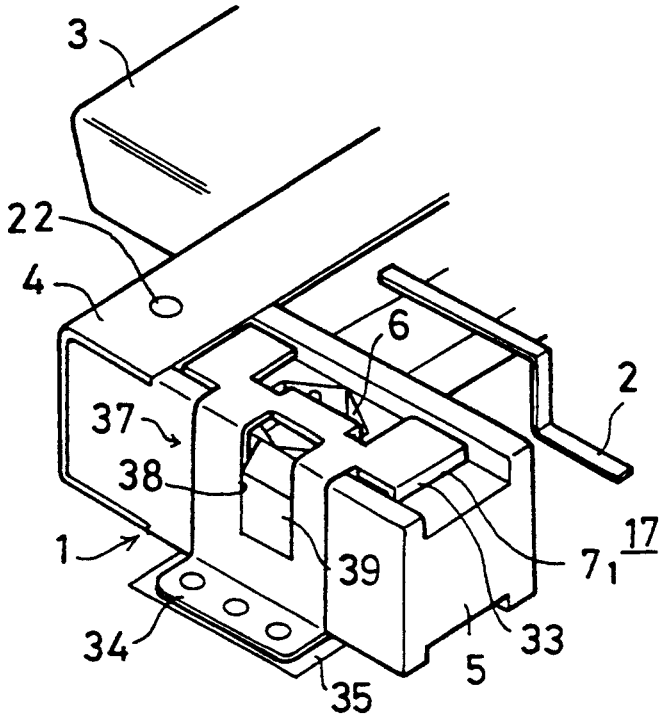
FIG. 9A is a perspective view of an important portion of the embodiment of the electrical connector shown in FIG. 8 as mounted on the printed wiring board.
Figure 9B:
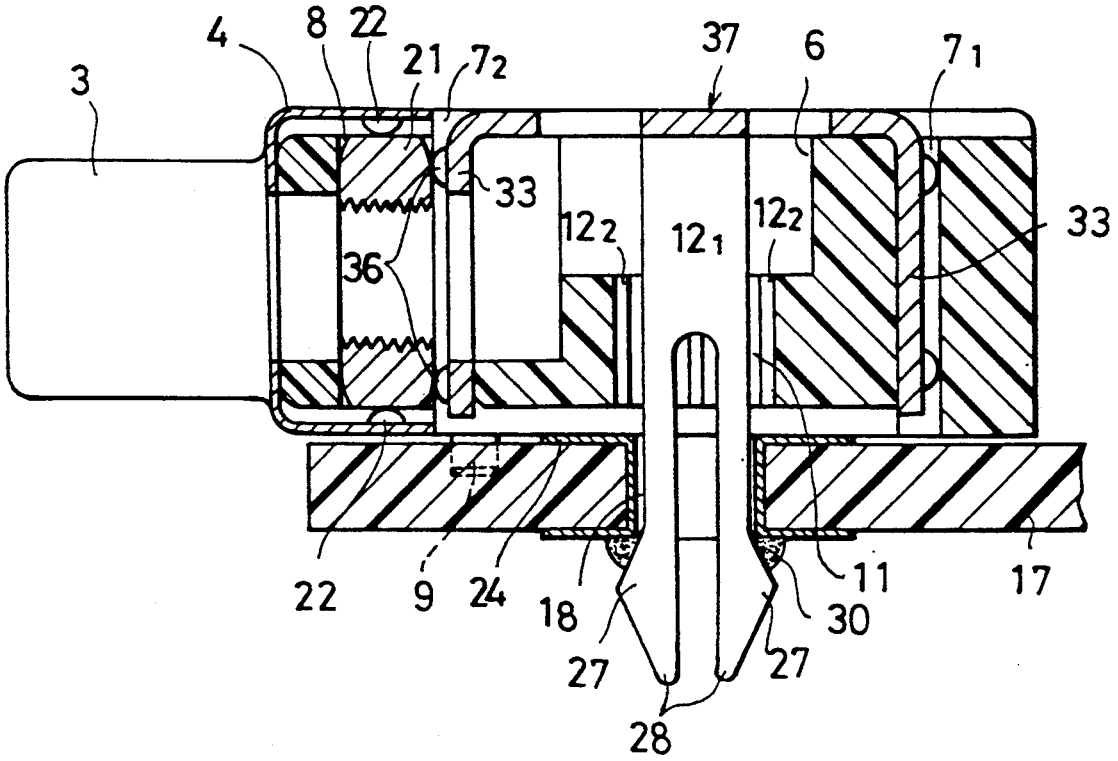
FIG. 9B is a sectional view thereof.

FIGS. 8 and 9 show a still another embodiment of the electrical connector of this invention shown in FIG. 1 which further includes a plate-like lock and hold-down member for mounting the electrical connector on the printed wiring board.

The plate-like lock and hold-down member 37 is a combination of an integral member of the above-mentioned hold-down member 32 and the above-mentioned plate-like lock member 26. The board locking portion is provided, by way of bending, between the pair of wing pieces 33, 33 of the hold-down member. The board locking portion is comprised of two pieces of branched pieces 28, 28 having, an outer sides thereof, locking projection 27, 27.

The plate-like lock and hold-down member 37 is fixed to the mounting portion 5 in the following manner. More particularly the branched pieces 28, 28 are inserted into the bolt-inserting aperture 11 of the connector main body 1 having mounted thereto the metallic shell 4. The branched pieces 28, 28 are projected beyond the lower surface of the connector main body 1 under a condition whereby the branched pieces 28, 28 are engaged with the pair of slots $12_2$, $12_2$. At the same time, the pair of wing pieces 33, 33 are pressingly inserted into the pair of slit-like apertures $7_1$, $7_2$.

In this embodiment, the branched pieces 28, 28 are inserted into the throughgoing hole 18 in the printed wiring board 17 by narrowing the distance therebetween. After temporarily fixing the branched pieces 28, 28 to the printed wiring board 17 with the locking projections 27, 27, the branched pieces 28, 28 are then fixed by pouring a solder 30. The board-locking portion 34 is also fixed to the electric conducting portion 35 of the printed wiring board 17 by soldering.

In this embodiment, the electrical connector can be more securely fixed to the printed wiring board 17 than the one shown in FIGS. 6 and 7.

Since this invention has the above-described structural arrangement it has the advantage and benefit of not requiring an electrical connector of different construction even if the method of connecting the electrical connector to the printed wiring board is different due to the user's own specification and, therefore, that the cost of the electrical connector becomes low.

It is readily apparent that the above-mentioned connector has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. An electrical connector for a printed wiring board, comprising:
   - a connector main body having a pair of mounting portions provided on both sides of the fitting portion which fits into a mating connector;
   - a pair of slit-like apertures which are disposed, in parallel, on both sides of each recess,
   - wherein said nut-placing recess has at a bottom portion thereof a bolt-inserting aperture, and
   - wherein said bolt-inserting aperture has at least a pair of grooves which are oppositely provided on an internal surface of said bolt-inserting aperture parallel to the axis thereof.

2. An electrical connector for a printed wiring board according to claim 1, further comprising:
   - a nut which is fitted into said nut-placing recess; and
   - a bolt for fastening the printed wiring board, said bolt being inserted into said bolt-inserting aperture and screwed into said nut.

3. An electrical connector for a printed wiring board according to claim 1, further comprising:
   - a plate-like lock member having two ends, one end thereof being fitted into one of said slit-like apertures, and the other end thereof which comprises a board-locking portion for locking said connector to the printed wiring board being extended beyond a lower surface of said connector main body through said pair of grooves.

4. An electrical connector for a printed wiring board according to claim 1, further comprising:

a nut which is fitted into said nut-placing recess;

a plate-like hold-down member having, on both ends of one direction, a pair of wing pieces, in parallel, which are fitted from above into said pair of slit-like apertures and, on one of remaining ends thereof, a board-fixing portion for fixing said electrical connector to the printed wiring board, said board-fixing portion being extended outwards at a lower surface of said connector main body; and a bolt for fastening a printed wiring board, said bolt being inserted into said bolt-inserting aperture and screwed into said nut.

5. An electrical connector for a printed wiring board according to claim 1, further comprising a plate-like lock and hold-down member which is integrally made up of a pair of wing pieces, in parallel, a board-locking portion for locking said connector to the printed wiring board, and a board-fixing portion for fixing said connector to the printed wiring board, wherein said pair of wing pieces, in parallel, are fitted from above into said pair of slit-like apertures, wherein said board-locking portion is extended beyond a lower surface of said electrical connector main body through said pair of grooves, and wherein said board-fixing portion is extended outwards at a lower surface of said connector main body.

* * * * *

UNITED STATES PATENT AND TRADEMARK OFFICE

CERTIFICATE OF CORRECTION

PATENT NO.: 5,249,983
DATED : October 5, 1993
INVENTOR(S): Yuji HIRAI

It is certified that error appears in the above-identified patent and that said Letters Patent is hereby corrected as shown below:

In column 6, between lines 47 and 48, insert

--a nut-placing recess provided on an upper surface of each of said mounting portions; and--

Signed and Sealed this

Sixteenth Day of July, 1996

*Attest:*

Bruce Lehman

BRUCE LEHMAN

*Attesting Officer*

*Commissioner of Patents and Trademarks*